United States Patent [19]

Banyay

[11] Patent Number: 4,708,593

[45] Date of Patent: Nov. 24, 1987

[54] SURGELESS COMBUSTION AIR BLOWER

[75] Inventor: H. Daniel Banyay, Zelienople, Pa.

[73] Assignee: Robinson Industries, Inc., Zelienople, Pa.

[21] Appl. No.: 834,546

[22] Filed: Feb. 28, 1986

[51] Int. Cl.[4] ..... F04D 17/08

[52] U.S. Cl. ..... 416/183; 416/185

[58] Field of Search ..... 416/213 A, 183, 223 B, 416/185; 415/143; 431/281

[56] References Cited

U.S. PATENT DOCUMENTS

| | | | |
|---|---|---|---|
| 1,437,609 | 12/1922 | Nusim | 416/185 |
| 1,955,483 | 4/1934 | Ballentine | 416/188 X |
| 2,399,852 | 5/1946 | Campbell et al. | 416/188 |
| 2,484,554 | 10/1949 | Concordia et al. | 416/188 |
| 3,260,443 | 7/1966 | Garnett et al. | 416/213 A X |
| 3,300,194 | 1/1967 | Flynn | 431/281 X |
| 3,323,465 | 6/1967 | Stillebroer | 415/143 X |
| 3,644,056 | 2/1972 | Wiselius | 416/176 X |
| 3,669,563 | 6/1972 | Corbett | 416/185 X |

FOREIGN PATENT DOCUMENTS

| | | | |
|---|---|---|---|
| 583578 | 9/1959 | Canada | 416/185 |
| 838192 | 5/1952 | Fed. Rep. of Germany | 416/183 |
| 959692 | 3/1957 | Fed. Rep. of Germany | 416/185 |
| 1138986 | 10/1962 | Fed. Rep. of Germany | 416/183 |
| 999826 | 2/1952 | France | 416/185 |
| 1325267 | 3/1973 | France | 416/183 |
| 492190 | 3/1954 | Italy | 416/185 |
| 269886 | 11/1950 | Switzerland | 416/183 |
| 662517 | 12/1951 | United Kingdom | 416/183 |
| 680040 | 10/1952 | United Kingdom | 416/185 |

*Primary Examiner*—Everette A. Powell, Jr.

*Attorney, Agent, or Firm*—Webb, Burden, Robinson & Webb

[57] ABSTRACT

A surgeless combustion air blower which, due to the incorporation therein of an impeller having a novel configuration and blade shape, does not surge under periods of low turn-down, and yet which demonstrates comparable volume capacity as conventional impellers of the same diameter. The novel configuration and blade shape of the impeller inhere in three design features of the impeller: (1) the wheel bears no shroud; (2) a quadrangular inducer appends the leading edge of each blade adjacent the hub, which inducer is bent between 40° and 50°, and preferably 45°, into the direction of rotation of the impeller; and (3) the blade tapers from a maximum chord immediately down-blade of the inducer to a minimum chord at its tip. In addition, the slope of the inducer-blade interface, or "bend line" of each inducer, opposes the predominant taper of the blade from which it appends. As a result of this novel configuration and blade shape, the impeller exerts constant or decreasing pressure throughout its entire volume range and, accordingly, does not precipitate surging during periods of reduced flow.

5 Claims, 3 Drawing Figures

SURGELESS COMBUSTION AIR BLOWER

FIELD OF THE INVENTION

The present invention relates to a shroudless centrifugal impeller assembly, and more particularly relates to a shroudless centrifugal impeller having blades and inducers of specified shape and orientation, which when incorporated into a combustion air blower facilitates the surgeless operation thereof.

BACKGROUND OF THE INVENTION

Centrifugal impellers are widely used in combustion air blowers, in which they provide a large volume of air for combustion purposes. In these blowers, the impeller assembly is mounted in a generally disc-shaped casing which has an inlet opening adjacent the axis of the impeller and a discharge opening at the outer radius of the casing. Air or other combustion gas is drawn into the impeller, which imparts a high velocity to the air or gas, and the casing directs the flow through the discharge opening and into the combustion system.

When a centrifugal blower is operated in the pressure-vs.-volume range for which it was designed, pulsation, or "surge," is seldom a problem. There are, however, circumstances in which it is necesary to keep the blower running during periods of decreased demand, i.e., during periods of "turn-down" in the combustion system for which drastic decreases in fluid flow, by volume, are typical. Unfortunately, many centrifugal impellers known in the art "surge" in response to turn-down conditions in the system, and the surging can result in improper fluid flow, overheating, and consequential damage to combustion equipment.

Surging normally results during "turn-down" from the inability of an impeller to exert equal or greater pressure on the closed combustion system as is exerted during the higher volume of fluid flow characteristic of normal operations. Conversely, as long as there is no pressure drop at the blower during periods of reduced air delivery, no pulsation or surging will result. If pressure drops at the locus of the blower, however, the sequence known as surging begins. This surging may be visualized in contrast with and in terms of the normal operation of the impeller.

Under ordinary operating conditions, the pressure exerted by the blower equals the pressure in the overall combustion system, and fluid flow proceeds normally. If the pressure decreases at the blower, due to a turn-down in fluid delivery, the pressure in the overall combustion system is momentarily greater than the pressure at the blower itself. Thus the air in the system tends to reverse its direction and flow back into the blower (this can be extremely dangerous in handling gas to a burner or combustion chamber) until both pressures become equalized. When this is achieved the blower again resumes its normal function of pumping air into the system--until the resistance in the system causes the sequence to repeat. It is this repetition which constitutes surging. The frequency and intensity of surging depends upon (1) the pressure-vs.-volume characteristics of the particular impeller, (2) the rate at which air is discharged from the system, and (3) the volume of the system into which the impeller is delivering air.

Previous attempts to minimize or eliminate surging concentrated on the operation of the impeller only within the pressure-vs.-volume range for which reduced impeller volume was unaccompanied by decreasd pressure. Implementation of such selective impeller operation usually required initial selection of an impeller which did not surge under conditions of the lowest anticipated turn-down but which also, as a result, usually did not operate with satisfactory volume capacity under ordinary combustion conditions. In addition, other attempts to eliminate surging provided for the use of inlet control dampers, blow-off valves and other auxiliary accessories which detracted from energy efficiency and provided, at best, a remedy for surging, not a preventive. As a result, a need persists for an impeller, for use in a combustion air blower, which demonstrates a surge point lower than the lowest anticipated turn-down and which preferably does not surge even under conditions of essentially 100% turn-down, in order to prevent surging, in the associated combustion system, before it occurs.

BRIEF DESCRIPTION OF THE INVENTION

In order to meet this need, the present invention is a surgeless combustion air blower which, due to the incorporation therein of an impeller having a novel configuration and blade shape, does not surge under periods of low turn-down, and yet which demonstrates comparable volume capacity as conventional impellers of the same diameter. The novel configuration and blade shape of the impeller inhere in three design features of the impeller: (1) the wheel bears no shroud; (2) a quadrangular inducer appends the leading edge of each blade adjacent the hub, which inducer is bent between 40° and 50°, and preferably 45°, into the direction of rotation of the impeller; and (3) the blade tapers from a maximum chord immediately down-blade of the inducer to a minimum chord at its tip. In addition, the slope of the inducer-blade interface, or "bend line" of each inducer, opposes the predominant taper of the blade from which it appends. As a result of this novel configuration and blade shape, the impeller exerts constant or decreasing pressure throughout its entire volume range and, accordingly, does not precipitate surging during periods of reduced flow.

DETAILED DESCRIPTION OF THE INVENTION

Figure 1:
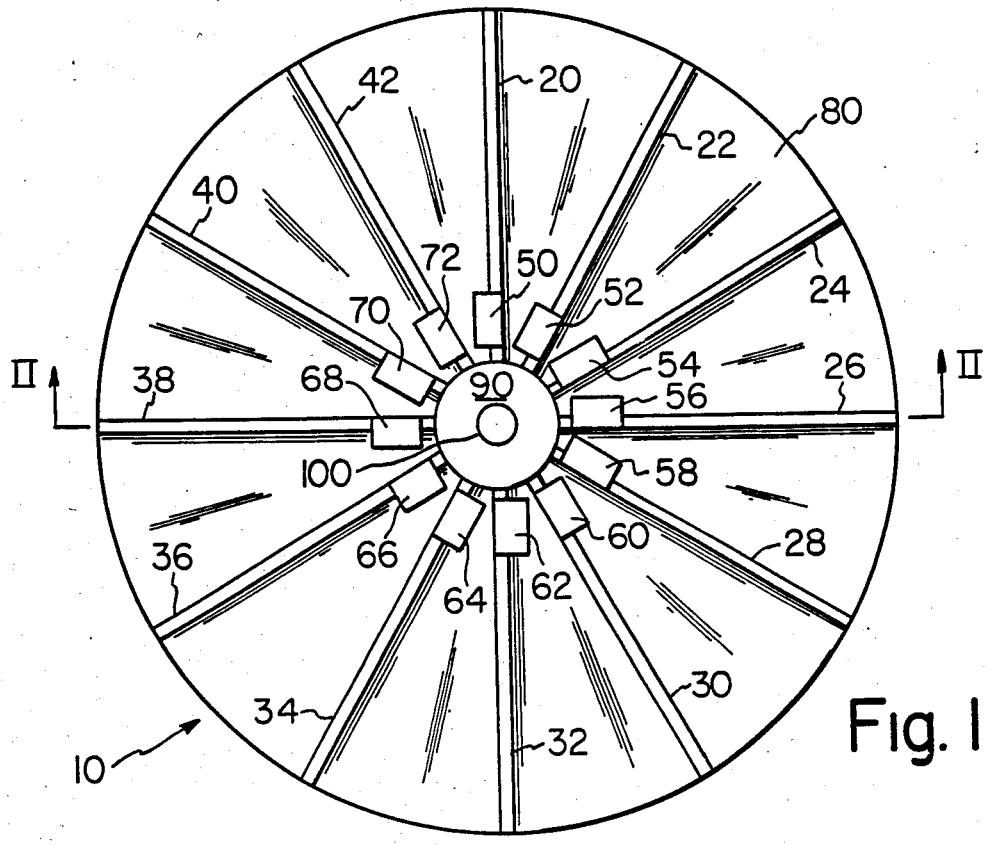
FIG. 1 is a side elevational view of the impeller, intended for counterclockwise rotation.
Figure 2:
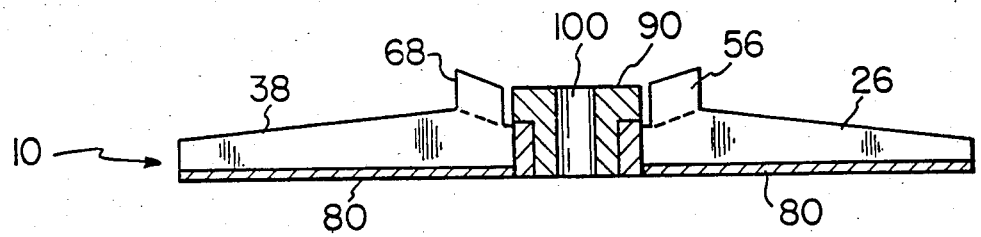
FIG. 2 is a sectional view along lines II—II of FIG. 1.

The present invention is a combustion air blower, and its associated impeller, which reduces or eliminates surging even in periods of low turndown as a result of the novel configuration and blade shape of the impeller. Referring now to FIGS. 1 and 2, the present impeller has a novel structure in that (1) it bears no shroud; (2) a plurality of quadrangular inducers 50, 52, 54, 56, 58, 60, 62, 64, 66, 68, 70 and 72 append the leading edge of each of a plurality of blades 20, 22, 24, 26, 28, 30, 32, 34, 36, 38, 40 and 42, respectively, at a locus adjacent the hub 90, which inducers are bent between 40° and 50°, and preferably 45°, into the direction of rotation of the impeller 10; and (3) each blade has a taper, from a maximum chord immediately downblade of the inducer to a minimum chord at its tip, which opposes the slope of the "bend line," or inducer-blade interface, of each inducer.

More particularly, and referring once again to FIG. 1, the present impeller 10 has a plurality of twelve blades 20, 22, 24, 26, 28, 30, 32, 34, 36, 38, 40 and 42 thereon, each of which extends radially outward from a hub 90 having a bore 100 therethrough. Each of the blades has one of a plurality of quadrangular inducers 50, 52, 54, 56, 58, 60, 62, 64, 66, 68, 70 and 72 thereon, as shown. Each inducer appends from less than one-fifth of the length of the leading edge of each blade. By "quadrangular," Applicant denotes that each inducer describes a quadrilateral parallelogram for which internal angles may vary.

Referring once again to FIG. 2, FIG. 2 illustrates a sectional view along line II-II of FIG. 1, showing the attachment of the blades 26 and 38 to the web 80 along the entire lengths thereof, in addition to the attachment of the blades 26 and 38 to the hub 90. Although FIG. 1 illustrates one important feature of the present invention, in which the inducers are bent between 40° and 50°, and preferably 45°, into the direction of rotation of the impeller, FIG. 2 illustrates the remaining elements of the impeller configuration which are essential to the present claimed invention.

As shown in FIG. 2, the impeller blades 26 and 38 each taper, from a maximum chord immediately downblade of the inducer, to a minimum chord at its tip. This is in contrast to prior art impeller blades which generally widen out to a tip area covered by a shroud. The present blades 26 and 38, in contrast with the prior art, bear no shroud.

Second, as illustrated in FIG. 2, the slope of the inducer-blade interface of each of the inducers 56 and 68 opposes the predominant taper of the respective blades 26 and 38 which they append. By "opposes," Applicant signififes that the slope and taper have opposite mathematic sign, i.e., either positive or negative. For example, if the line described by the blade taper has a positive slope (depending on its orientation in space), the slope of the inducer-blade interface will be negative, and vice versa. The angle of taper of each blade 26 and 38 is 8°–12°, and preferably is 10°, relative to the line described by the web 80. Furthermore, the slope of the bend line of each of the inducers is 10°–30°, and preferably is 15°, relative to the same line but, as described above, the slope of the bend line opposes the blade taper in all instances.

Although FIG. 2 illustrates the sectional view along line II—II of FIG. 1, each blade of the impeller is identical. Accordingly, FIG. 2 is also representational of any of six sectional views along any of the linear six pairs of impeller blades as shown in FIG. 1.

Ordinarily, the impeller of the present invention is assembled as shown in FIGS. 1 and 2 prior to being mounted on a driven shaft (via bore 100) and prior to insertion into the casing of a centrifugal blower. The sequence of assembling the elements of the impeller is not critical, but may be carried out by means and with materials known in the art.

Figure 3:
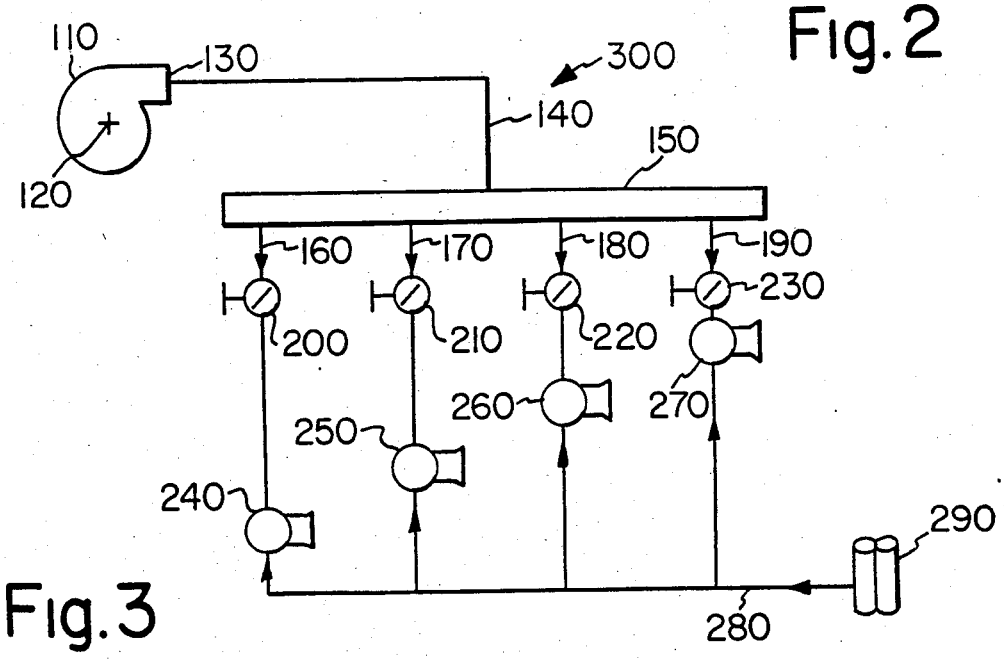
FIG. 3 is a schematic diagram of a combustion system 300, in which a centrifugal blower 110 provides combustion air via the air supply manifold 150 to a plurality of burners 240, 250, 260 and 270.

Referring now to FIG. 3, the centrifugal blower 110, having a conventional disc-shaped casing and containing the impeller according to the present invention, is shown in position in a schematic diagram of a representative combustion system 300 for which the centrifugal blower 110 minimizes or eliminates surging. Combustion air enters the centrifugal blower 110 via inlet 120; high velocity combustion air is thus directed into blower duct 140 via discharge opening 130. The combustion air is directed from the blower duct 140 into the air supply ducts 160, 170, 180 and 190 via the air supply manifold 150. The volume of combustion air which reaches the burners 240, 250, 260 and 270 is regulated via air control valves 200, 210, 220 and 230. Combustion proceeds as needed when the required ratio of fuel (relative to combustion air) is injected from the fuel supply 290 to the burners 240, 250, 260 and 270 via the fuel supply duct 280. The combustion system 300 may thus be summarized as a plurality of burners having a fuel supply and a combustion air supply thereto, wherein the combustion air is provided by a centrifugal blower having an impeller therein.

As may be seen in the context of the combustion system illustrated in FIG. 3, the present invention inheres in the incorporation of an impeller, having a novel configuration and blade shape, into a centrifugal blower of a combustion system. Apart from a combustion system such as that described, the phenomenon of surging in response to turn-down conditions would not occur. Within a combustion system as a whole, however, the novel structure of the present impeller minimizes or eliminates the surging associated with prior art centrifugal blowers.

The present impeller will be further illustrated by the following Example.

EXAMPLE I

The impeller of FIG. 1 was assembled by mounting twelve blades onto a disc-shaped web 80 which was $24\frac{1}{4}$ inches in diameter. Each blade, exclusive of the inducer thereon, had a 2 inch chord immediately adjacent the hub 90, and $1\frac{5}{8}$ inch chord at its tip. The hub 90 measured $4\frac{1}{2}$ inches in diameter.

A $\frac{3}{4}$ inch quadrangular inducer appended each blade as shown in FIG. 2, and was bent at the inducer-blade interface 45° into the direction of rotation of the impeller. The inducer-blade interface had a slope of approximately 15° relative to the line described by the web 80, and the blade tapered at an angle of 10°, from the inducer to the blade tip, relative to the same line. The slope of each inducer-blade interface opposed the taper of each blade. The diameter of the impeller from inducer to opposite inducer measured $11\frac{3}{4}$ inches.

Upon testing of the impeller from 0 up to approximately 6000 cubic feet per minute (CFM) air delivery, associated pressure dropped steadily from a high at 0 CFM to zero at 6000 CFM, with 3000 CFM being the normal operating volume of the impeller in the combustion system. Accordingly, during operation, decrease in volume output of the impeller did not result in increased pressure anywhere in its volume capacity range, and as a result the impeller did not precipitate surging even after essentially 100% turn-down of the associated combustion system.

The invention is to be limited only insofar as is set forth in the accompanying claims.

I claim:

1. A surgeless impeller for use in a combustion air blower comprising:

a shroudless wheel having a disc-shaped web and a plurality of blades thereon;

each of said blades having a leading edge thereon opposite said discshaped web;

each of said blades further having one of a plurality of quadrangular inducers appended thereto at said leading edge thereof adjacent said hub, each of said quadrangular inducers further having the shape of a quadrilateral parallelogram;

each of said blades further having a tapered structure defined by a maximum chord immediately downblade of the inducer of said blade and a minimum chord at the tip of said blade, wherein said leading edge of said blade defines a straight line between said inducer and said tip;

each of said blades further having an inducer-blade interface which is defined by a straight line having a slope which opposes the taper of said blade; and each of said quadrangular inducers being bent at said inducer-blade interface about 45° into the direction of rotation of said impeller.

2. The surgeless impeller of claim 1, wherein said plurality of blades numbers twelve.

3. The surgeless impeller of claim 2, wherein each of said plurality of quadrangular inducers is bent between 40° and 50° into the direction of rotation of said wheel.

4. The surgeless impeller of claim 3, wherein each of said plurality of blades tapers at an angle of 10° relative to the plane described by said web.

5. A combustion system, comprising:

a plurality of burners having a fuel supply and a combustion air supply thereto, wherein said combustion air is provided by a centrifugal blower having an impeller therein, said impeller having the structural features as claimed in claim 1.

* * * * *